US006786361B2

(12) United States Patent
Moothart et al.

(10) Patent No.: US 6,786,361 B2
(45) Date of Patent: Sep. 7, 2004

(54) BEVERAGE COOLING AND DISPENSING DEVICE

(76) Inventors: Martin Joseph Moothart, 1802 Magdalene Manor Dr., Tampa, FL (US) 33613; David Rubin Aslin, 1109 19th Ave., Longview, WA (US) 98632

( * ) Notice: Subject to any disclaimer, the term of this patent is extended or adjusted under 35 U.S.C. 154(b) by 13 days.

(21) Appl. No.: 10/067,577

(22) Filed: Feb. 7, 2002

(65) Prior Publication Data

US 2003/0146241 A1 Aug. 7, 2003

(51) Int. Cl.[7] ..... B67D 5/64

(52) U.S. Cl. ..... 222/130; 222/142.5; 222/146.6; 222/113; 362/101; 62/400

(58) Field of Search ..... 222/130, 131, 222/142.5, 146.1, 146.6, 153.01, 153.09, 185.01, 113; 62/389, 398, 400; 362/101, 96, 156, 154

(56) References Cited

U.S. PATENT DOCUMENTS

| | | | | | |
|---|---|---|---|---|---|
| 470,745 | A | * | 3/1892 | Conant | 222/131 |
| 488,473 | A | * | 12/1892 | Fruen | 222/131 |
| 685,063 | A | * | 10/1901 | Sauer | 217/75 |
| 912,281 | A | * | 2/1909 | Brunner et al. | 222/131 |
| 1,006,475 | A | * | 10/1911 | Gardner | 220/569 |
| 1,095,517 | A | * | 5/1914 | Parshall | 366/147 |
| 1,196,621 | A | * | 8/1916 | Weinberg | 222/131 |
| 1,535,927 | A | * | 4/1925 | Look | 137/212 |
| 1,572,242 | A | * | 2/1926 | McLaughlin | 62/392 |
| 1,625,803 | A | * | 4/1927 | Haas et al. | 62/400 |
| 1,656,782 | A | * | 1/1928 | Efstathiou | 366/107 |
| 1,732,996 | A | * | 10/1929 | Wandel | 222/129 |
| 1,788,442 | A | * | 1/1931 | Saugman | 62/392 |
| 2,088,376 | A | * | 7/1937 | Kaskey | 366/256 |
| 2,261,276 | A | * | 11/1941 | Patterson | 62/392 |
| 3,059,452 | A | * | 10/1962 | Griffin | 62/457.2 |
| 4,878,363 | A | * | 11/1989 | Wells et al. | 62/400 |
| 6,053,367 | A | * | 4/2000 | Pejoine | 222/185.1 |
| 6,286,719 | B1 | * | 9/2001 | Haines | 222/113 |

* cited by examiner

*Primary Examiner*—Gene Mancene
*Assistant Examiner*—Frederick Nicolas
(74) *Attorney, Agent, or Firm*—Irving Keschner

(57) ABSTRACT

A primarily cylindrical beverage cooling despiser (10), devised of two separate portions, by which collectively make up the exterior and interior.

The upper portion consists of two separate chambers, one interior chamber (14) for containment of ice for cooling, and one exterior chamber (12) for containment of beverage. Both chambers though mutually exclusive of each other, once filled with their intended containment by virtue of their connective proximity to one another associate a thermal communication with one another resulting in the cooling of contained beverage. Additionally the upper portion includes a lid (56), comprised as a common two-in-one combination lid.

The bottom portion of the exterior is represented as the base (16), which supports the upper portions contents and additionally supports a tap/faucet (18), and tap/faucet handle (20) arrangement for the controlled release of the contained beverage content.

2 Claims, 5 Drawing Sheets

BEVERAGE COOLING AND DISPENSING DEVICE

BACKGROUND—FIELD OF INVENTION

This invention relates to beverage dispensers and related beverage dispensing delivery devices, specifically to such dispensers and devices with intent to keep the beverage cooled.

BACKGROUND OF THE INVENTION

It has long been recognized and known to be desirable to keep a beverage contained in a pitcher, or beverage dispenser with intent of delivering cool beverages, it's content the beverage, to be poured and delivered cooled without diluting such beverage by the addition of ice. Although the addition of ice to a beverage such as ice water may be both satisfactory as well as desirable, the addition of ice to a beverage such as beer would usually be considered highly undesirable.

PRIOR ART

The 1869 patent to Piesch, U.S. Pat. No. 93,001 entitled "Pitcher" is seen to represent an effort to keep the contents of a pitcher cool by providing an ice chamber J in which chunks of ice may be maintained. Although this arrangement is generally functional, it involves a considerable part of the interior of the pitcher being utilized for containing the ice, with the result that the volume available in the pitcher for the beverage is relatively small.

The Mock U.S. Pat. No. 1,771,186 entitled "Serving Element for Electric Refrigerators" was an improvement over Piesch in that it involved the use of a serving element having double walls, with the space between the walls being partially but not completely filled with water. This patentee envisions his serving element placed upside down in an electric refrigerator, for example, such that ice forms in the space between the walls. As a consequence of this arrangement, when the walls commences to melt and to chill the beverage. This arrangement is only good for one serving of beverage, with the serving container having to be cycled through another cooling process in a refrigerator before it would be suitable for chilling another container of beverage.

The keg or barrel has inner and outer walls held in spaced relation by tubes which serve both as a refrigerating as well as a spacing means. Carbon dioxide is utilized as a gaseous refrigerant. It is obvious that the Kellogg teaching would not be pertinent to the cooling of a pitcher, or any table top easily portable beverage dispenser such as a pitcher or portable beverage dispenser utilized for containing beer or other desired beverages, but rather would be limited to a comparatively large scale cooling arrangement.

Other patentees such as the Smith U.S. Pat. No. 2,526,165, the Paquin U.S. Pat. No. 3,413,820 and the Crowell U.S. Pat. No. 4,691,644 have taught the use of placing cooling means in a receptacle, but in none of these instances was the arrangement such that a pitcher or any likewise dispenser for the intent to deliver beer, for example, able to consistently deliver and maintain at a desirably low temperature it's intended delivery beverage.

It was in an effort to overcome the limitations of these and other such devices that the present invention was designed.

OBJECTS AND ADVANTAGES

One object of the present invention is to eliminate typical pitcher spillage a mess typically associated with pouring beverages from said pitchers.

An additional object of the present invention is to provide a more sanitary means by which to deliver desirable beverages by virtue of the devices detachable two-in-one combination lid.

It is another object of the present invention to provide a beverage cooling device that can in many instances be utilized as an advertising display medium by display art inserted or etched into the inner or outer transparent cylinders or elsewhere as desired.

Additionally another object of the present invention is to efficiently remove heat from a beverage contained within the device when the beverage is in thermal communication with the device.

Moreover it is the primary object of the present invention to deliver in an efficient sanitary fashion desired beverages consistently cooled without the watering down effect created by ice melting directly into the beverage. Regarding many beverages, such a dilution created by melting ice into the beverage is commonly regarded as a highly negative effect.

It is a final object of the present invention to provide a beverage cooling device that is of relative simple construction, aesthetically appealing and very functional in its intent. These and other objects, features and advantages will be apparent from a study of the enclosed drawings.

SUMMARY OF THE INVENTION

The device of the present invention overcomes the above mentioned shortcomings. The device overcomes such shortcomings by introducing itself as a self-contained beverage cooling device not limited to the before mentioned limitations due to relying on other devices other than itself for the delivery of its intended beverage. The device is not an out of place appearing add-on to the standard existing pitchers, or related devices, the present invention in many instances replaces those pitchers and other related devices for it's intended use.

The present invention is a portable tabletop beverage dispenser that is portable like said standard pitchers but with cooling and easy pouring capabilities beyond said pitchers and devices. The present invention primarily consists of the following. A lightly weighted base, which is stabilized as to not tilt or tip over during dispensing cooled beverage, additionally the base houses a no-drip easy to use tap/faucet for ease of pouring the desired cooled beverage. The tap/faucet enables the user of said device to pour any desired amount of cooled beverage without the typical spillage mess often associated with pouring beverages from standard pitchers, additionally said device eliminates lifting of a pitcher to pour, required of pitchers and most other portable devices for the same. The present invention has an inner chamber, an inner transparent removable cylinder which may be filled with ice to cool the beverage contained in the outer chamber, or filled with water and refrigerated for insertion into the device for cooling the intended to be delivered beverage contents contained within the outer transparent cylinder. Additionally the device has an outer beverage containment chamber devised by means of a larger than the inner transparent removable cylinder, the larger outer transparent cylinder is the chamber which holds the desired beverage that is intended to be poured and delivered.

Additionally the device has advantages to standard pitchers and other related portable beverage dispensing devices in that it also has a lidded top, a detachable two-in-one combination lid which disallows foreign undesirable objects to enter either the ice cooling chamber or the beverage to be delivered containment area.

The present inventions intent is to be filled within its outer transparent beverage containment chamber with desirable beverage, and additionally filled within its separate inner transparent ice containment chamber ice, allowing for the cooling of said beverage contained within the invention, without dilution caused by melting ice to the desired contained beverage that will be poured and delivered as desired. The beverage to be poured and delivered by virtue of the devices easy to manipulate tap/faucet, the device is stabilized for ease of pouring by virtue of the inventions lightly weighted stable base.

The device is relatively simple, straightforward, and inexpensive to construct and use. The object of the present invention is to provide a tabletop easily portable beverage cooling device that is aesthetically appealing, has both novelty and function.

BRIEF DESCRIPTION OF THE DRAWINGS

FIG. 7A is a fragmented perspective showing the lids, in place, attached to the inner and outer cylinders. FIG. 7B shows a bottom side view of the detachable two-in-one combination lid. FIG. 7C shows a cross section taken from FIG. 7B.

DRAWINGS—REFERENCE NUMERALS

10) Beverage cooling and dispensing device.
12) Outer transparent cylinder.
14) Inner transparent removable cylinder.
16) Base.
18) Tap/faucet assembly.
20) Tap/faucet handle.
22) Tap/faucet gasket.
24) Tap/faucet mounting boss.
26) Top surface of base.
28) Interior recessed surface of base.
30) Threaded hole for tap/faucet.
32) Bottom of base.
34) Inside bottom of inner transparent removable cylinder.
36) Void area inside inner transparent removable cylinder.
38) Void area inside outer transparent cylinder.
40) Notched cut-away for lock-down of inner transparent removable cylinder.
42) Support flange for inner transparent removable cylinder.
44) Protruding appendages on support flange for the lock-down of the inner transparent removable cylinder.
46) Alternate Base for inner transparent removable cylinder.
48) Alternate method of attachment for inner transparent removable cylinder.
50) Alternate protruding appendages for the lock-down of the inner transparent removable cylinder.
52) Alternate base for a permanent attachment of inner transparent cylinder.
54) Alternate inner transparent cylinder, permanently attached.
56) Detachable two-in-one combination lid.
58) Exterior lip of lid.
60) Exterior lip of lid.
62) Cut-out area of lid.
64) Top of solid lid.
66) Top of lid with cut-out.
68) Two-in-one lid connection piece.

DETAILED DESCRIPTION OF THE PREFERRED EMBODIMENT

Figure 1:
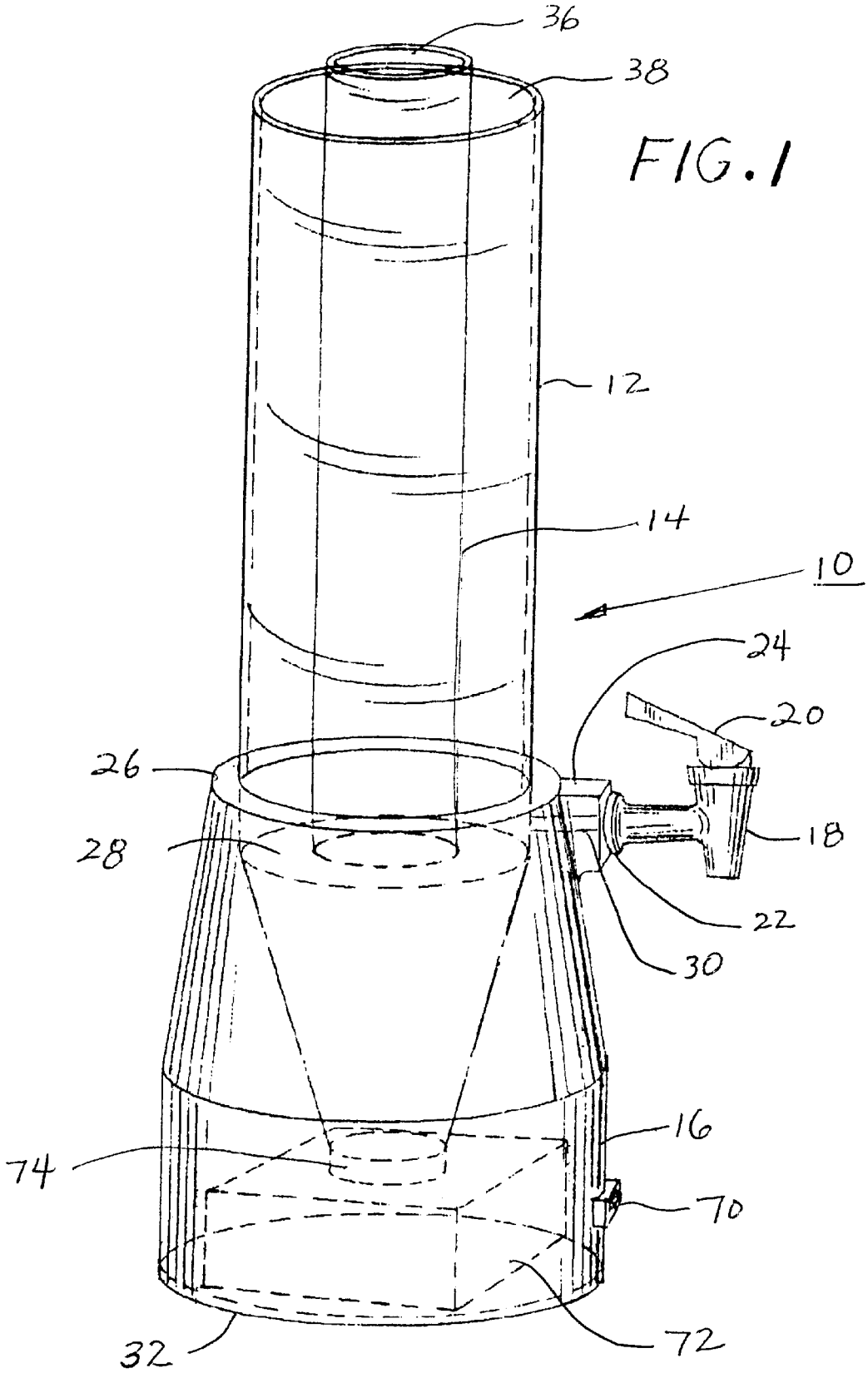
FIG. 1 is a perspective view of the beverage cooling and dispensing device shown in its preferred embodiment.

FIG. 1 is a perspective view of the beverage cooling and dispensing device shown in its preferred embodiment. Which consists of a main body 10, which of itself consists of an upper and lower portion of the device. The upper portion of this main body 10 in its preferred embodiment is comprised of two cylindrical transparent cylinders, that could additionally be made nontransparent and or, of any color. The larger by diameter outer transparent cylinder 12, is posed fixed permanently attached to the lower nontransparent portion of the base 28 and 16, collectively making up the upper exterior of the main body 10. Disposed within the upper main body 10 inside the larger by diameter outer transparent cylinder 12, is the smaller by diameter inner transparent removable cylinder 14. Both transparent cylinders 12 and 14 have two separate individual hollow interiors 38 and 36. The inner transparent removable cylinder 14 may be filled within its interior void 36 with ice or may be detached, removed to fill with water and freeze for cooling the devices contained beverage. The outer transparent cylinder 12 which may be affixed or detachable, has an inside void area 38 devised for beverage containment. The upper and lower portions of the preferred embodiment of the present invention 10, are represented primarily as cylindrical in aesthetic configuration both upper and lower portions of the preferred embodiment 10 may be made in numerous geometric configurations without disrupting function or intent. The lower portion of the main body 10 which of itself is represented as the base 16, in its preferred embodiment is represented as nontransparent. But could be transparent, or of any color and have surface texture or a flat-finished surface. The top of the base 16 has a surface 26, which serves as a connective point joining the lower base 16 and 28 with the outer transparent cylinder 12. The bottom of the base 32 is devised to lend stability and support for the entire embodiment of the present invention 10. The base 16 additionally supports the tap/faucet assembly 18, the tap/faucet handle 20, the tap/faucet gasket 22, the tap/faucet mounting boss 24 and the threaded hole for the insertion of the tap/faucet 30 along with all of its assemblies are collectively cohesive for the intent to pour for delivery contained cooled beverage held within the void area 38 inside the outer transparent cylinder 12 devised for beverage containment.

The main body 10 is permanently and completely sealed in all areas that water tightness is required 26 and 28. A continuous even flow of beverage will dispense from the present invention 10 when duly desired by intentional physical manipulation of the tap/faucet system, 18, 20, 22, 24, and 30, by virtue of continuous unimpeded gravity flow.

The lower half of the main body 10 is shown in its preferred embodiment to be constructed from a solid color heat and impact resistant dishwasher safe polymer. It could in fact be adequately constructed from any number of other materials such as aluminum and other such alloys, and be colored in any fashion, and its upper half consisting of the transparent cylinders 12 and 14 are shown in its preferred embodiment to be made from transparent heat and impact resistant dishwasher safe polymer additionally the upper half of the main body 10 consisting of the transparent cylinders could be made from any number of materials such as glass, aluminum or other such alloys and may be made nontransparent and or, colored in any fashion without disrupting the present inventions functional intent.

Figure 2:
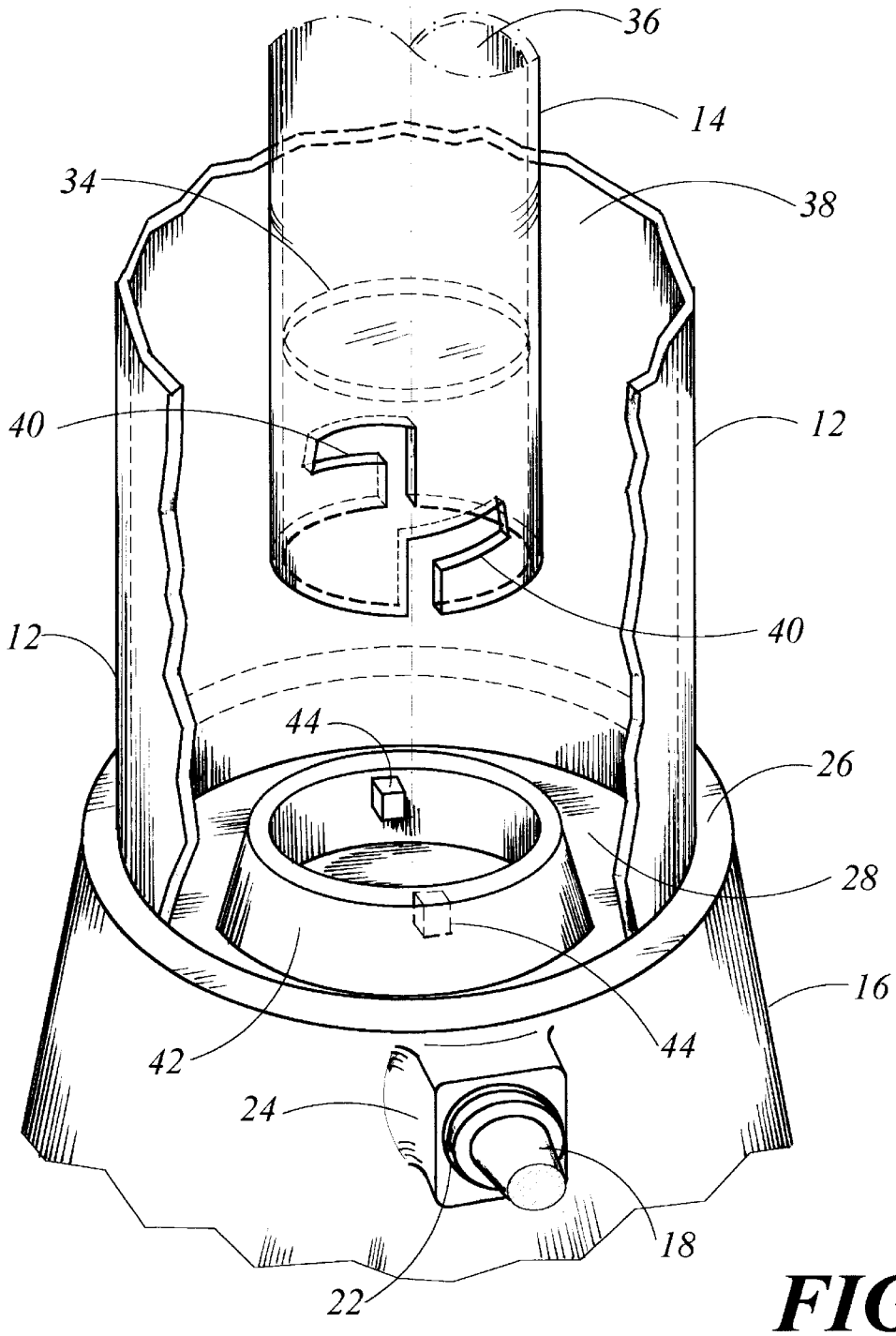
FIG. 2 is a fragmented perspective view of the preferred embodiment showing how the inner transparent removable cylinder, used for cooling, is notched and mechanically fastened to the base.

FIG. 2 is a fragmentary perspective view of the preferred embodiment of the present inventions joining lock-down capability devised to temporarily join the removable inner transparent cylinder 14 into an upright locked position joined and supported in place by the support flange 42 and its protruding appendages 44. Shown additionally is a fragmentary view of the outer cylinder 12 and its beverage containment void 38, along with its connection with the base 16 and the top surface of the base 26. Additionally shown is the inner transparent removable cylinder 14, which with its voided area 36 serves as an ice containment chamber. Located at the lower proximity of the inner transparent removable cylinder 14 is its solid inside bottom 34, just below that is the inner transparent removable cylinders notched cut-away areas 40 devised for lock-down and joining of the inner transparent removable cylinder 14 with the base 16 where it will than reside on the recessed surface of the base 28. Additionally the related detachable joining areas between the inner transparent removable cylinder 14 and the interior recessed surface of the base 28 could also be made permanently joined, as represented in 54. Shown additionally are the tap/faucet mounting boss 24, the tap/faucet gasket 22, and the tap/faucets related assembly 18.

Figure 3:
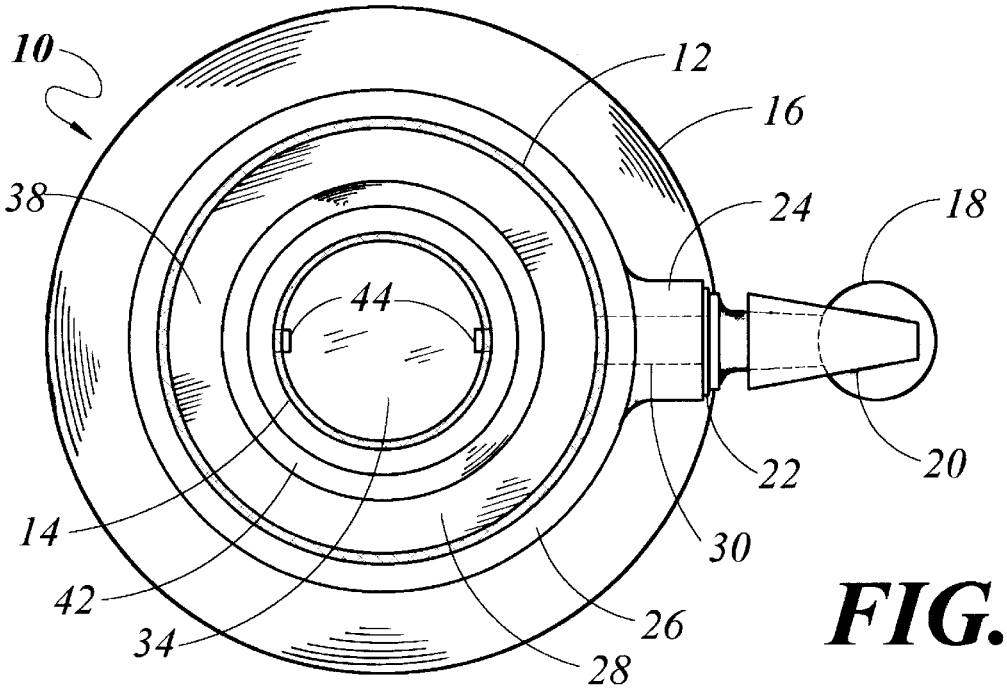
FIG. 3 is a plan (top side) view of the preferred embodiment of the present invention.

FIG. 3 is a plan (top side) perspective view of the preferred embodiment of the present invention 10. Which is represented primarily as cylindrical ellipses comprised of the base 16, the top surface of the base 26, the outer transparent cylinder 12, the support flanges 42, the inner transparent removable cylinder 14, the inside bottom of the inner transparent removable cylinder 34, and the protruding appendages on the support flange for the lock-down of the inner transparent removable cylinder 44. Also shown in this topographical view, attached to the primarily cylindrical configurations is the tap/faucet system. Which is comprised of its related housings and components 18, 20, 22, 24, additionally with the threaded hole 30, allows connective fluid transfer between the tap/faucet system and the contained beverage in the outer transparent cylinder 12 held within its beverage containment area 38.

Figure 4:
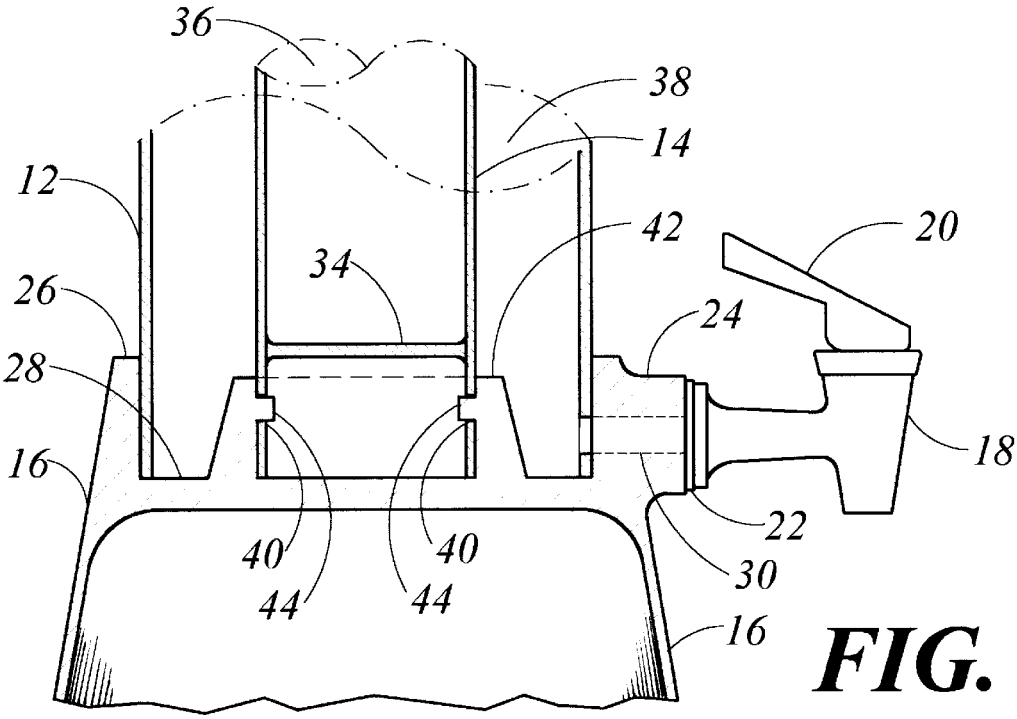
FIG. 4 is a fragmentary cross section of the preferred embodiment of the present invention.

FIG. 4 is a fragmented cross section of the preferred embodiment of the present invention. Shown as a side perspective view is the mechanically detachable lock-down capability devised for the temporary joining of the inner transparent removable cylinder 14 and the devices interior recessed surface base 28. This detachable locking configuration devised for the stable union of the inner transparent removable cylinder 14, with its notched cut-away 40, is best envisioned as the male portion of this locking capability as it fits down and into the support flange 42 whereby physically manipulating a quarter twist-turn of the inner transparent removable cylinder 14 will lock-down and become securely held by connective friction into the recessed surface base 28. This union between the inner transparent removable cylinder 14 and the devices interior recessed surface base 28 is additionally joined and supported in place by the interior support flange 42 along with its protruding appendages 44 which are located on and inside the support flange 42, all of which is best represented as the locking configurations female counter contact point devised for excepting penetration, and to lend upright support of its male counter, the inner transparent removable cylinder 14. Additionally shown just above the notched cut-away, located at the lower end inside is the inner transparent removable cylinder 14 is the cylinders solid inside bottom 34. Also shown represented in this side perspective view of the present invention is the outer transparent cylinder 12 and its void area 36, and the inner transparent removable cylinder 14, with its void area 38. Shown are the base of the preferred embodiment 16 and the top surface of the base 26, along with the tap/faucet assembly 18, and all of the tap/faucets connective embodiments represented additionally as 20, 22, 24, and 30.

Figure 5:
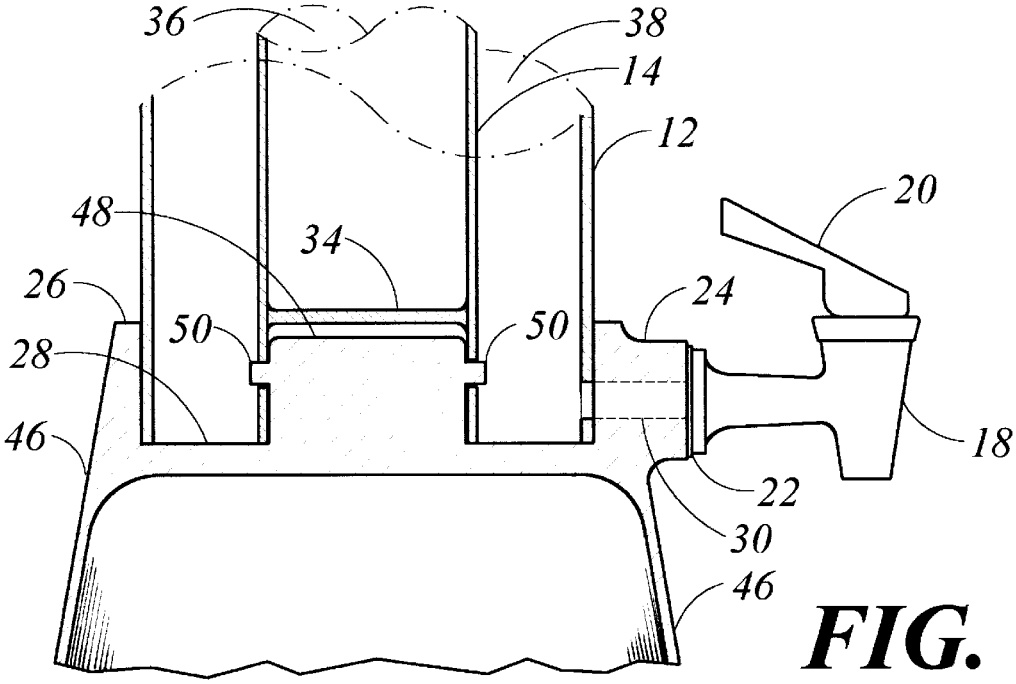
FIG. 5 is a fragmentary cross section similar to FIG. 4 showing an alternate method of mechanically attaching the inner transparent removable notched cylinder to the base.

FIG. 5 is a fragmentary cross section similar to FIG. 4 showing an alternate method of mechanically attaching temporarily the inner transparent removable cylinder 14 to the recessed surface base 28. This detachable locking configuration additionally devised as an effective method for the stable union of the inner transparent removable cylinder 14, along with its notched cut-away 40, is collectively best envisioned as the female portion of this locking capability. Which can be temporarily and stably joined with the recessed surface base 28 and its associated protrusions and appendages 48 and 50 by slipping over and onto its protrusion 48, with its locking appendages 50 which collectively are best envisioned as male. The male protrusion 48 which protrudes upwards from the recessed surface base 28 along with its locking appendages 50 effecting lock-down with the inner transparent removable cylinder 14 by its penetration of the inside of the inner transparent removable cylinder 14, by means of physically manipulating a quarter twist of the inner transparent removable cylinder 14 down and onto its male host protrusion 48 with its locking appendages 50. Additionally shown is a fragmentary perspective view of the present inventions outer transparent cylinder 12 with its internal containment void area 38. Also shown is the inner transparent removable cylinder 14 with its internal containment void area 36 and the inside bottom of the inner transparent removable cylinder 14 its base 34. Represented additionally is the alternate base configuration 46 along with its top surface 26, and the tap/faucet assembly 18 collectively shown are the tap/faucets additional embodiments, the tap/faucet handle 20, the tap/faucet gasket 22, the tap/faucet mounting boss 24, and the threaded hole for the tap/faucet 30.

Figure 6:
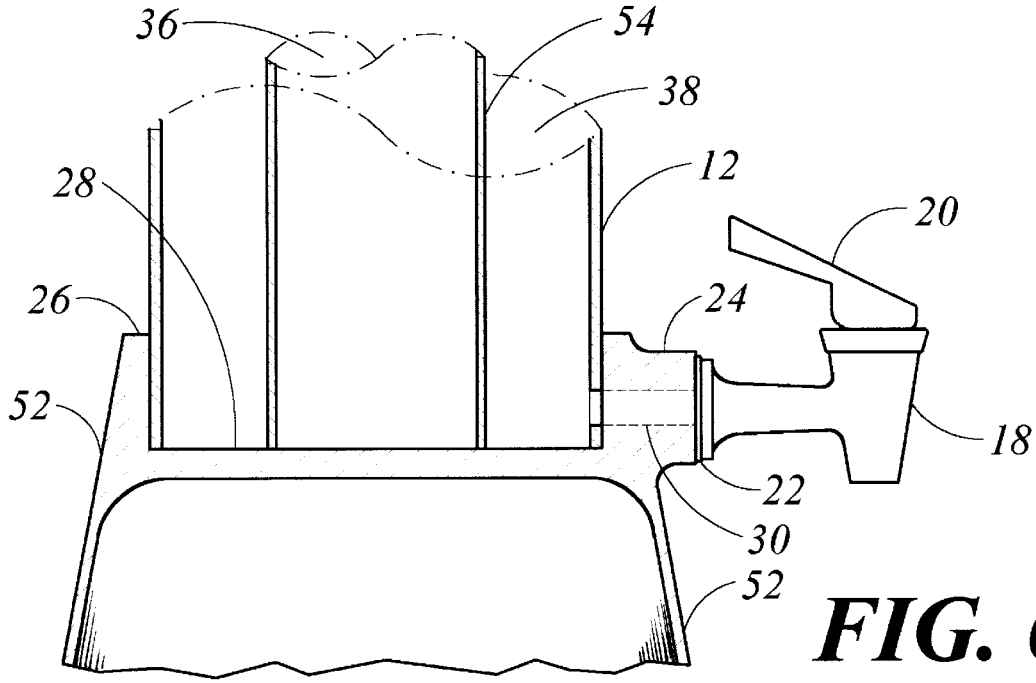
FIG. 6 is a fragmentary cross section similar to FIG. 4 showing an alternative method by having the inner transparent cylinder permanently attached to the base.
Figure 7A:
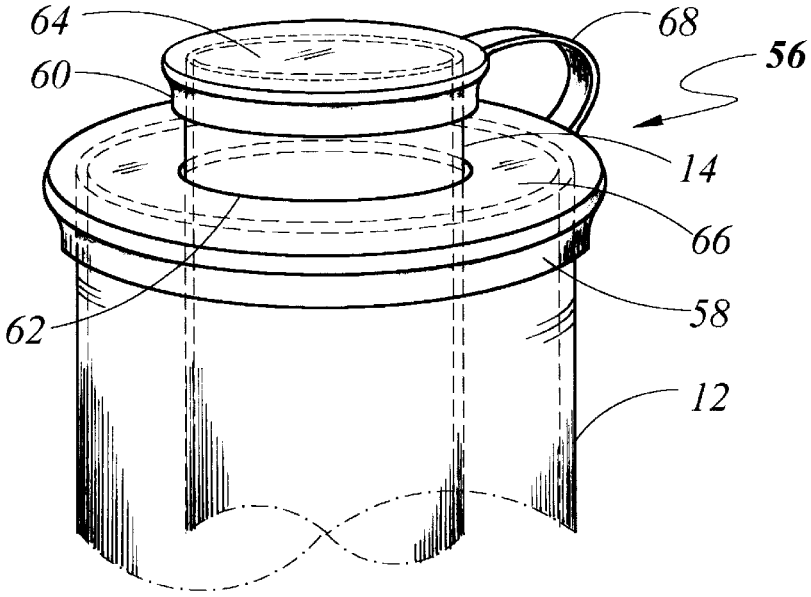
FIGS. 7A to 7C shows the detachable two-in-one combination lid.
Figure 7C:
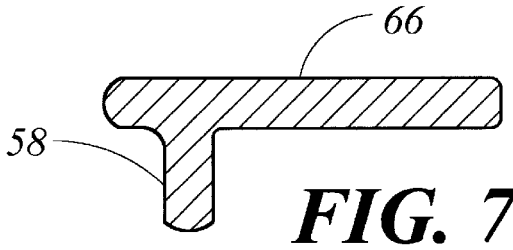
Figure 7B:
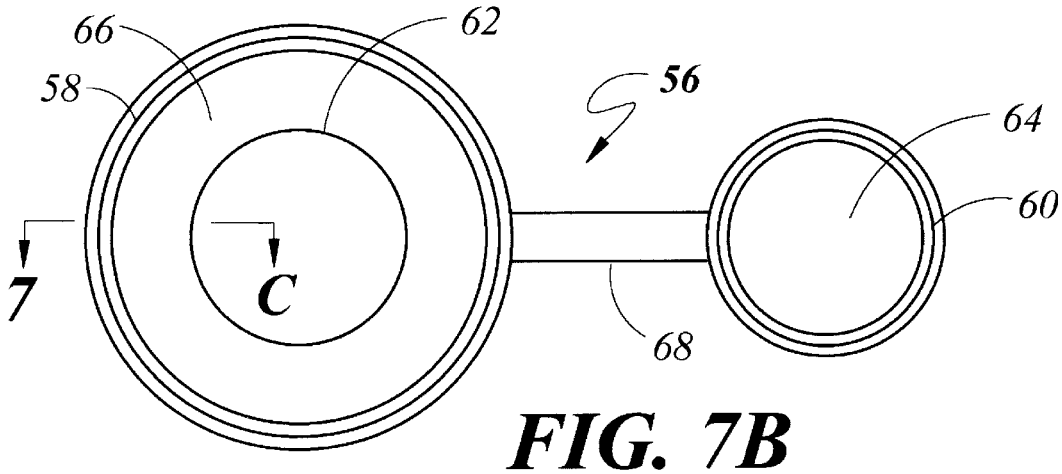

FIG. 6 is a fragmentary cross section similar to FIG. 4 showing an alternate method by having the inner transparent cylinder 54 permanently attached to the interior recessed surface of the base 28 residing inside of its alternate base 52. Attachment between the inner transparent cylinder 54 and the interior recessed surface of the base 28 can be achieved by any manor and number of ways including but not limited to welding, gluing, or molding together. Additionally shown is the void area 36 located within the inner transparent cylinder 14, and the void area 38 located within the outer transparent cylinder 12. Also shown is the top surface of the base 26 and the tap/faucet assembly 18, along with all of the tap/faucets connective embodiments represented additionally as 20, 22, 24, and 30.

7 to 7C are perspective views of the preferred embodiment of the present inventions two-in-one combination lid 56, see additionally 58, 60, 62, 64, 66, and 68. This two-in-one combination lid 56 effectually may be applied or removed each half independently of the other, to fasten fixed on top of the devices transparent cylinders 12 and 14. Simultaneous application of both haves of the lid system effects substantial increased efficiency of the devices cooling capabilities as well as allowing for a much more protected sanitary delivery of the present inventions deliverable beverage content.

The two-in-one combination lid 56, is comprised primarily of two separate lids 64 and 66, and are joined as one assembly by a connection piece 68. The combination two-in-one lid feature 56, becomes increasingly essential when the device is to be used outdoors. In addition to significantly reducing undesired foreign objects from being introduced into the devices contained beverage. The two-in-one combination lid 56 aides significantly to increasing the efficiency of cooling the present inventions contained beverage by captured thermal communication between the ice contained within the inner transparent cylinder 14, within its ice containment void area 36, and the beverage contained within the device inside the beverage void area 38. Additionally sustained cooling is greatly enhanced by the two-in-one combination lid 56 by virtue of its ability to cover the contents both ice and beverage, contained within the device. Thereby significantly retarding the effect of unnecessary premature warming of the devices contained beverage and ice which could be caused if not lidded, either by direct or indirect exposure to sunlight.

One half of the combination two-in-one lid 56, which is represented as the half which has the cut-out center 66, allows this half of the combination two-in-one lid 56, to slide over the slightly taller, smaller by diameter inner transparent removable cylinder 14, this cut-out half of the combination two-in-one lid 56 configures to allow it to rest atop the shorter in height but larger by diameter outer transparent cylinder 12 effectively covering its contained beverage inside its beverage containment void area 38. This half of the configured combination two-in-one lid 56, allows ice to be inserted into the inner transparent removable cylinder 14 into its containment void 36, without ice spillage into the transparent outer cylinder 12, by virtue that the lid 66 covers the beverage void area 38 which is the beverages containment ingress point, thereby disallowing the introduction of ice into the beverage containment void area 38. Additionally the solid piece half of the two-in-one combination lid 64 which is devised to cover the contents inside the inner transparent removable cylinder 14, this half of the two-in-one combination lid 56 56 may be removed independently from its other half (the cut-out half 66) for the insertion of additional ice into the inner transparent removable cylinder 14 within its ice containment void area 36 as desired.

In its preferred embodiment the two-in-one combination lid 56 in its entirety is represented as 56, 58, 60, 62, 64, 66 and 68, and is made from heat and impact resistant dishwasher safe polymer, but could be made with adequate functionality from any number of various materials such as aluminum or likewise other alloys.

Operation of the Prefered Embodiment

Operation FIGS. 1, 7A, 7B, 7C

In order for the user of the present invention FIG. 1 to optimally utilize this device the beverage cooling and dispensing device 10 for its intent, to contain and than deliver desired cooled beverage, it is:

1. First necessary to partially remove from FIG. 1 the present invention 10, FIGS. 7A to 7C the detachable two-in-one combination lid 56, by removing entirely one half of this detachable two-in-one lid 64 and 60.
2. Leaving the other half of the two-in-one combination lid 56, the cut-out centered half 62, 66, 58 and 68 in place covering FIG. 1 the outer transparent beverage containment chamber 12 and 38 the user should than insert ice until full, not to exceed the devices maximum ice fill capacity, into FIG. 1 the inner transparent removable cylinder 14 and 36 which function as a space for ice containment.
3. The user should than remove the entire two-in-one combination lid 56, and than full the outer transparent beverage containment area 12 and 38 with the amount of preferred beverage that is desired not to exceed the maximum beverage fill capacity of the device for containment and later delivery of said beverage.
4. It is recommended at this point that the user now attach into position both haves of the two-in-one combination lid 56, by first slipping onto and over the inner transparent removable cylinder for ice containment void area 36 the cut-out area of the lid 62, 66, and 58, until it is seated properly down onto the top of the outer transparent cylinder 12 and its beverage containment void area 38, thereby effectively covering the beverage containment area.
5. It is recommended that the user now attach by pushing gently to snap-down the other half of the two-in-one combination lid 56, 60, and 64 down onto the inner transparent removable cylinder 14 which has been made easy to accomplish by virtue that the inner transparent removable cylinder 14 is of a height slightly elevated above the height of the outer transparent cylinder 12, thereby now achieving effectual coverage of both transparent cylinders the inner transparent removable cylinder 14 and the outer transparent cylinder 12.
6. The user can now deliver the cooled beverage by pouring the desired beverage into a receiver glass, which can be any number of drink containers such as a common drinking glass or mug or other such devices for the same.
7. To affect pouring and delivery of said preferred and now cooled beverage the user need merely place a beverage receiver such as the before mentioned common drinking glass or other of such device under FIG. 1 just under the beverage cooling and dispensing device 10, its tap/faucet 18, than the user can actuate pouring of the devices contained beverage by pulling back or pushing forward on the tap/faucet handle 20, once the handle is actuated cooled beverage will than dispense via gravity flow.

Description Additional Embodyment

FIG. 1 The main body 10 can be aesthetically enhanced many ways by various decorations and additionally by many various aesthetically pleasing advertising means. The main body 10 can be decorated to resemble a palm tree etc., or any number of ways to enhance its individuality with relations to various markets.

The present invention is represented in its preferred embodiment at its upper portion 10, 14 and 12 is devised to be FIGS. 1, 2, 3, 4, 5, 6 and 7A transparent. And at its lower portion of FIG. 1, 2, 3, 4, 5, 6 and 7A its embodiment 10 at its base 16 is represented to be of a single color. The device could be devised effectually to be made of any known color or any combination of color at any part of its preferred embodiment 10, or in its entirety. Additionally numerous appealing aesthetic enhancing designs including those of beverage manufacturers could easily be affixed to, or within the device 10 in any number or manner of ways including but not limited to marketing brand names and slogans fixed to FIG. 1 inside of the inner transparent removable cylinder 14 or related to the same to FIG. 1 the outside of the outer transparent cylinder 12, or any portion of its preferred embodiment 10.

The non-transparent portion of FIG. 1 the main body 10, its base 16, may be textured for function or aesthetics or be non-textured.

It is anticipated that all components for the various embodiments of the present invention 10 will be dishwasher safe for easy cleaning.

Additionally there can be made to serve varying purpose many external as well as internal modifications primarily aesthetic, though of some increased functionality by nature. It will be understood that each of the elements described, or two or more elements in combination with each other, may also find a useful application in other types of methods differing from the type henceforth described.

One such addition would be the insertion of a lighting lantern device 17 into FIG. 1 the base 16, and 32 of the device. Activated by means of turning on or off by method of switching mechanism 19 located on the exterior of the devices base 16. Such a lighting mechanism could then effectually shine upward from FIG. 1 the base 16 through a transparent interior recessed base 28, shinning additionally upward into and throughout FIG. 1 both transparent cylinders 14 and 12. Effectively illuminating both FIG. 1 the inner transparent removable cylinder 14 designated for the containment of ice within its void area 36, devised to cool the devices contained beverage, and illuminating additionally the outer transparent cylinder 12 designated for the containment and eventual dispensing of the contained beverage held within the void area 38 thereby creating a desirable lighting effect most visually noted as an effective luminous transition in a low light environment.

Additionally a Lazy Suzan type of rotating platform mechanism attached to FIG. 1 the devices base 16 and 32 would be an additional characteristic that could easily be devised to complement the functionality of the device. Whereby making it more attractive for larger numbers of users to enjoy full advantage of self-service of beverage being dispensed from the present invention 10. This rotating platform base feature would allow each individual sitting at a table to rotate in either direction the devices tap/faucet 18 to position it as such to minimize the need for one individual to pour and tend beverage from the device 10 for the group.

While the invention has been particularly shown and described with reference to embodiments thereof, it will be understood by those skilled in the art that various changes to the present inventions embodiments in form and detail may be made without departing from the spirit and scope of the present invention.

Operation Additional Embodiment

Operation FIGS. 1, 2, 3, 4, 5, 6

Operation 1. Commercial aesthetic enhancement:

a) First an understanding of the market for which the device of the present inventions 10 position of fulfillment would suffice must be achieved before the ascertainment of the potential modifications of commercial aesthetic enhancement of FIG. 1 the preferred embodiment of the present invention 10 can or should be devised.

b) Then by fluid means of commercial advertising application structural compliance within the limits of possibility could be adapted according with the demand in any number of varying manor such as commercial advertising banners, signs or logo's etc. Additionally and not limited to modified geometric configuration of the devices embodiment 10. Color changes to the preferred embodiment or other fabricated material changes to any portion of the present embodiment or any one or any combination thereof may be desirable to specifically modify the present inventions structural aesthetics to each possible individual circumstance accordingly, each commercial application being unique.

Operation 2. Internal light mechanism:

a) An optional lighting mechanism would be a desirable addition to the present inventions FIG. 1 embodiment 10 by means of the insertion of a lantern device into the base 16 of the present invention, whereby a light could be actuated by the user of the device by means of intentional physical manipulation of a common on/off switching mechanism, to the on or off position.

b) To turn the device light on. The user of the present invention by intentionally physically actuating the common light switching mechanism to the on position the device would then become illuminated within its upper portion of its embodiment 10 which is comprised of FIGS. 1, 2, 3, 4, 5, and 6 which consists of two transparent cylinders 12 and 14, the outer transparent cylinder 12 and its beverage containment void area 38, being the focus of the aesthetic illumination enhancing effect.

c) To turn the light off. The user of the present invention upon intentionally physically actuating the common light switching mechanism to its off position would disengage the lighting mechanisms luminous enhancing effect.

Operation 3. Rotating platform base attachment:

a) An optional simple rotating platform commonly called a Lazy Suzan could be attached or permanently affixed to the base 16 and 32. Though not included in the present inventions preferred embodiment this may be a desirable addition. Whereby the user of the present invention could effect ease of distribution of the contained cooled beverage to large numbers of individuals seated at a table.

b) The user(s) of the present invention would merely by intentional physical manipulation turn by holding onto the base 16 of FIG. 1 the device 10 and rotate the device either clockwise or counter-clockwise allowing the device to pivot/swivel effectually due to the rotating platform base attachment Lazy Suzan to point the devices tap/faucet 18 in the desired direction to position straight before each intended user recipient of the devices contained beverage.

Conclusions, Ramifications, and Scope

The reader shall thus see that the present invention with its design intent to efficiently and effectively cool and dispense desirable beverages without the diluting of said beverages provides a highly reliable, easy to operate device that can be used and enjoyed by persons of almost any age for a wide range and variety of preferred beverages, especially those beverages that are commonly held as beverages that are highly desired to be served properly, effectively and consistently cooled and not watered down.

The reader by examination shall see that the device of the present invention allows for a greatly increased level of sanitation with respect to its intended to be poured and delivered totally contained beverage, by virtue of the devices lid covered beverage and ice containment chambers.

The reader shall thus see that accurate and ease of pouring beverages above that of standard pitchers is achieved by means of the present inventions easy to operate gravity flow no-drip tap/faucet. Which is elevated to such a height above table level attached to the present inventions base as to easily accommodate any number of common drinking glass containers allowing proper fit under the present inventions tap/faucet.

Additional stability for pouring contained beverages from the present invention is enhanced by its stable base. Which of itself significantly reduces the problem of tipping over and beverage spillage a problem also associated with common beverage pitchers.

By examination the reader shall see that the present invention consistently and effectively cools beverages without diluting the beverage content by virtue of its separated ice and beverage containment chambers, allowing many such beverages that ice dilution would be regarded to be a negative effect such as but not limited to Beer, to be served as they were intended in of themselves not effected by the direct introduction of melting ice.

The reader shall additionally see by examination that in addition to greatly enhancing both the cooling capability of the present invention as well as adding a high level of sanitation in the containment and delivery of cooled beverage. The two-in-one combination lid enables the device to be filled with ice without the problem of ice falling into the beverage containment chamber.

While my above description contains many specificities, these should not be construed as limitations on the scope of the present invention, but rather as an exemplification of one preferred embodiment thereof. Many other variations are possible and could in fact be desirable in their function. For example, there can be many cosmetic enhancements to suffice specific marketing needs by which the exterior or additionally in many cases the interior of the device could be altered to accommodate. Such as the commercial application of the exterior of the device shaped to resemble any number of sports drink logos or manufacturers of Beer devising a means to showcase their product by means of aesthetic cosmetic advertising enhancement. As well as many advertising banners or signs that could be related to the present invention by any number of assorted attachments all by any manor that would be fitting and of proper aesthetically enhanced design. Some additional ramifications would include that the present invention may be made in varying proportionate size, varying to accommodate its necessity. Additional ramifications would include that the present invention in its preferred embodiment may be made from any number of varying ways such as injection molding or vacuum molding of polymers. It may additionally be developed from any number of metals including aluminum or other such alloys as deemed fitting. The transparent portions of the present invention in their preferred embodiment may be made of transparent polymer or glass, but additionally can be made non-transparent and devised from any number of the before mentioned ways and means such as produced of aluminum or other such alloys as deemed fitting. The present inventions base in its preferred embodiment may be made from a polymer but it to in fact could be adequately constructed by means of any number of metals such as aluminum, or any other alloy deemed fitting.

Accordingly, the scope of the present invention should be determined not by the embodiment(s) illustrated, but by the appended claims and their legal equivalents.

What is claimed is:

1. A portable device for containing, cooling and dispensing beverages, comprising:

a. a sealed container comprising side walls with inner and outer independent chambers, the inner chamber being detachable, the outer chamber being fixed or detachable, having a common bottom and two independent common open top ends which together comprise a common open top, chamber components and tap faucet affixed upon a common base;

b. said two in one combination lid top closure when removed giving access to said inner and outer separated sealed chambers, the inner said chamber being filled with beverage, thereby effecting chilling of said beverage by thermal communication between said coolant and separated beverage;

c. said chilled beverage being dispensed and delivered for consumption by activating in accordance with said attached tap faucet handle and tap faucet for the pouring and delivery of said chilled beverage;

d. whereby said beverage is dispensed by means of gravity flow created by the delivery from the beverage filled chamber due by its elevated presence above the tap faucet causing beverage to pour out the tap faucet as a direct effect of intentional tap faucet handle manipulation and by gravity thereby dispensing said beverage; and e. light means housed in said base and directing light, when activated, up through said inner and outer chambers.

2. The device of claim 1 wherein said base is rotatable.

* * * * *

UNITED STATES PATENT AND TRADEMARK OFFICE

CERTIFICATE OF CORRECTION

PATENT NO. : 6,786,361 B2
APPLICATION NO. : 10/067577
DATED : September 7, 2004
INVENTOR(S) : Martin Moothart et al.

It is certified that error appears in the above-identified patent and that said Letters Patent is hereby corrected as shown below:

In column 12, line 24, "inner" should read --outer--.

Signed and Sealed this

Nineteenth Day of August, 2008

JON W. DUDAS
*Director of the United States Patent and Trademark Office*